US005718569A

United States Patent [19]

Holst

[11] Patent Number: 5,718,569

[45] Date of Patent: Feb. 17, 1998

[54] DUAL PLUNGER CASSETTE PUMP

[75] Inventor: Peter A. Holst, Castro Valley, Calif.

[73] Assignee: Abbott Laboratories, Abbott Park, Ill.

[21] Appl. No.: 585,366

[22] Filed: Jan. 11, 1996

[51] Int. Cl.[6] ..... F04B 43/00

[52] U.S. Cl. ..... 417/479; 417/440; 417/510; 417/521; 137/624.18; 251/331; 604/153

[58] Field of Search ..... 417/413.1, 440, 417/479, 510, 521; 137/522, 624.18; 251/331, 335.2; 604/153, 155

[56] References Cited

U.S. PATENT DOCUMENTS

| | | | |
|---|---|---|---|
| 3,282,224 | 11/1966 | Bock et al. | 417/413.1 |
| 4,277,226 | 7/1981 | Archibald | 604/153 |
| 4,303,376 | 12/1981 | Siekmann | 417/510 |
| 4,776,775 | 10/1988 | Conally | 417/510 |
| 4,838,860 | 6/1989 | Groshong et al. | 604/152 |
| 4,842,584 | 6/1989 | Pastrone | 604/50 |
| 4,898,579 | 2/1990 | Groshong et al. | 604/67 |
| 4,927,411 | 5/1990 | Pastrone et al. | 604/153 |
| 5,039,279 | 8/1991 | Natwick et al. | 417/479 |
| 5,358,385 | 10/1994 | Wang | 417/413.1 |

*Primary Examiner*—Charles G. Freay
*Attorney, Agent, or Firm*—Neal D. Marcus; Ronald W. Anderson

[57] ABSTRACT

An IV pump actuates a disposable cassette having two parallel fluid paths that include first and second pumping chambers. The disposable cassette (12) has a housing(14) that includes a back portion (152) in which is defined a fluid path (60) between an inlet port (16) and an outlet port (18). An elastomeric membrane (150) is sealed between the back portion and a front portion (52). The elastomeric membrane is exposed through the front portion at a first pumping chamber (82), a second pumping chamber (84), inlet valves (70, 76), and outlet valves (86, 92). The inlet valves operate in a fully open mode, a fully closed mode, and a cracking mode. The cracking mode of the inlet valve occurs as the elastomeric membrane is initially forced further into the pumping chamber. If the pressure of the fluid in the pumping chamber exceeds a predetermined cracking pressure, the inlet valve is forced open so that the fluid flows from the pumping chamber back toward the inlet port. The inlet valve then fully closes and fluid flows through the outlet valve. Since fluid is forced alternatively from the first and second pumping chambers, the flow from the outlet port is substantially continuous. During the pumping stroke, operation of the inlet valves in the cracking mode compensates for variations in the proximal pressure. The outlet valves can also be operated in a cracking mode to compensate for variations in the pressure distal to the cassette.

22 Claims, 7 Drawing Sheets

DUAL PLUNGER CASSETTE PUMP

FIELD OF THE INVENTION

The present invention generally relates to a medical pump for infusing a medicinal fluid into a patient, and more specifically, to a cassette pump having an elastomeric membrane sandwiched between a front and a rear housing, so that displacement of the membrane into a pumping chamber formed in the cassette forces fluid to flow through the cassette and into the patient.

BACKGROUND OF THE INVENTION

Cassette pumps provide a convenient and relatively low cost device for infusing drugs into the body of a patient. These pumps employ cassettes made of injection molded plastic, which are discarded after use with a patient. A pump designed to operate with a particular configuration of cassette includes a drive mechanism that actuates the cassette to deliver fluids to a patient. Such pumps are typically controlled by a microprocessor that can be programmed to deliver a predefined volume of medicinal fluid, at a predefined rate, and over a predefined time. Cassette pumps are typically more accurate than peristaltic pumps and are able to deliver drugs at a relatively wide range of rates and volumes.

In a cassette pump disclosed in U.S. Pat. No. 4,824,584, which is assigned to the same assignee as the present invention, the cassette comprises a housing having a front portion that includes openings for valve actuators and a pump plunger, and a rear portion in which passages, valve seats, and a pumping chamber are formed. An elastomeric membrane is sealed between the front and rear portions of the cassette body. The elastomeric membrane seals the passages formed in the rear portion and is displaced by the valve actuators to close valves formed in the housing and by a pump plunger to force fluid through the cassette. The fluid enters the cassette housing through either a primary or a secondary inlet port and is forced through an outlet port under pressure. The cassette pump delivers fluid to the outlet port when the pump plunger forces the elastomeric membrane into the pumping chamber to displace the fluid. During an intake stroke, the outlet valve closes, the inlet valve opens, and the pump plunger draws back. The fluid is then drawn through the open inlet valve and into the pumping chamber as the elastomeric membrane covering the pumping chamber pulls back from its prior fully displaced configuration. In a pumping stroke, the inlet valve closes, the outlet valve opens, and the pump plunger forces the elastomeric membrane back into the pumping chamber to force the fluid contained therein through the outlet port. Thus, the fluid flows from the cassette in a series of spaced-apart pulses rather than in a continuous flow.

Most of the work done in pumping fluid as described above is expended in displacing the elastomeric membrane and in moving the pumping plunger through the intake stroke. Since cassette pumps of this type are often energized with a battery power supply, it would be preferable if more of the energy used by the pumping plunger were expended in moving fluid through the cassette, thereby improving the efficiency of the device.

Ideally, a cassette pump should be relatively insensitive to upstream and downstream pressure variations in delivering fluid to the patient at the desired flow rate and volume. However, most prior art cassette pumps are affected by fluid pressure at the inlet port and to some extent, at the outlet port. A higher inlet port pressure, e.g., due to an increased elevation of the fluid reservoir relative to the pump (head pressure), often causes the flow rate to exceed the desired setting to which the pump is programmed. Conversely, a partially restricted fluid line connected to the outlet port can increase the pressure at that point and reduce the flow rate of the medicinal fluid delivered to the patient to a level below the desired setting.

Peristaltic pumps force fluid through a fluid line by compressing a section of the line while the line is closed upstream of the section. A pump of this type that is provided with "cracking valves" both upstream and downstream of the section from which fluid is displaced by compression of the line is disclosed in U.S. Pat. No. 5,055,001. This patent is also assigned to the same assignee as the present invention. The inlet valve on the pump operates in a cracking mode, a fully open mode, and a fully closed mode, and the outlet valve operates in a cracking mode and a fully closed mode. During an intake portion of a pumping cycle, the inlet valve is fully open, the outlet valve is fully closed, and the section of the line that will be compressed is filled with fluid. During the next portion of the pumping cycle, the inlet valve is operated in the cracking mode and the outlet valve remains fully closed. When the fluid pressure in the section of the line being compressed is above a predefined cracking pressure during an initial part of the compression stroke, the fluid is forced back through the inlet valve. Next, the inlet valve fully closes and the outlet valve changes to a cracking mode as the compression of the section of line continues. When the pressure of the fluid in the section of the line being compressed exceeds the predefined cracking pressure, the fluid is forced past the outlet valve. Accordingly, fluid is delivered to the patient at a flow rate that is relatively independent of the pressure upstream or downstream of the pump.

It would be desirable to provide a cassette pump in which cracking valves are used to minimize the effect of variations in the pressure upstream (and possibly downstream) of the pump on the flow rate of the fluid delivered by the pump. A cassette pump achieving this benefit and having a continuous output flow is not disclosed in the prior art.

SUMMARY OF THE INVENTION

In accordance with the present invention, a cassette is provided for use in a medical pump. The cassette includes a housing having an inlet port and an outlet port, and the housing has a front portion and a rear portion between which is sealed an elastomeric membrane that cooperates with the housing to define a fluid path within the housing between the inlet port and the outlet port. The fluid path includes two parallel flow segments. First and second pumping chambers are disposed in the respective parallel flow segments of the fluid path. One side of each pumping chamber comprises a portion of the elastomeric membrane. First and second inlet valves and first and second outlet valves are also respectively disposed in the two parallel flow segments of the fluid path to control fluid flow into and out of the pumping chambers. A repetitive displacement of the elastomeric membrane into the pumping chambers in sequence forces fluid from the pumping chambers and through the outlet port in a continuous flow.

Another aspect of the present invention is directed to a cassette pump for delivering a continuous flow of a medicinal fluid to a patient. The cassette pump employees a cassette like that described in the preceding paragraph. A pump housing is provided for receiving the cassette, and a prime mover, disposed within the pump housing, is drivingly coupled to a first pump plunger and a second pump plunger for successively displacing the elastomeric membrane respectively into the first pumping chamber and then into the second pumping chamber in a repetitive sequence. Displacement of the elastomeric membrane into the pumping chambers forces the medicinal fluid therefrom. A plurality of valve actuators are drivingly coupled to the prime mover to apply force to the elastomeric membrane to actuate the inlet and outlet valves. The valve actuators extend through the openings in the housing of the cassette at the first and second inlet valves and at the first and second outlet valves, to open and close the first and second inlet valves and the first and second outlet valves during a pumping cycle in synchronization with the displacement of the first and second pump plungers respectively into the first and second pumping chambers. Repetitive displacement of the medicinal fluid from one of the first and second pumping chambers by the elastomeric membrane followed by displacement of the medicinal fluid from the other pumping chamber by the elastomeric membrane produces the continuous flow of the medicinal fluid from the outlet port.

The prime mover is preferably coupled to the first and second pump plungers by a linkage that includes a rocker arm having opposite ends coupled to the first and second plungers. The rocker arm is driven to rock back and forth, so as to reciprocatively move the first and second pump plungers, by a yoke that extends between the rocker arm and a drive wheel. The drive wheel is rotated about a center of rotation by the prime mover, and the yoke is pivotally coupled to a point on the drive wheel that is offset from the center of rotation of the drive wheel.

In the preferred embodiment, the first and second inlet valves are cracking valves that operate in a fully open mode, a fully closed mode, and a cracking mode. Operation in the cracking mode enables the medicinal fluid to flow back toward the inlet port when a pressure of the medicinal fluid within a respective one of the first and second pumping chambers exceeds a predetermined cracking pressure during an initial displacement of the elastomeric membrane into the respective one of the first and second pumping chambers. Displacement of the medicinal fluid from the pumping chambers during the cracking mode minimizes any effect of a variation in a pressure of the medicinal fluid at the inlet port on a flow rate of the medicinal fluid delivered from the outlet port. Optionally, the first and second outlet valves comprise cracking valves that operate in a fully closed mode and a cracking mode, so that fluid is forced through the outlet port past the first and second cracking valves only when the pressure of the fluid in the first and second pumping chambers, respectively, exceeds the predefined cracking pressure. In this manner, the effect of distal pressure variations on the flow rate of the fluid from the cassette is minimized.

The cassette pump further preferably comprises a distal pressure sensor for monitoring a pressure of the medicinal fluid delivered from the output port.

With regard to the preferred embodiment, the first and second pump plungers depress the elastomeric membrane part way into the first and second pumping chambers when the cassette is inserted into the pump housing, ensuring that the elastomeric membrane over the pumping chambers is always under tension.

The cassette pump further comprises an anti-free flow valve disposed between the inlet port and the first and second inlet valves. The anti-free flow valve blocks fluid flow through the cassette until the cassette is engaged by the valve actuators. A pin is provided to open the anti-free flow valve when the cassette is inserted into the pump housing. The anti-free flow valve comprises a chamber formed in the housing of the cassette and having an inlet passage. The inlet passage is blocked by a flap that depends from the elastomeric membrane and covers the inlet passage into the chamber while the cassette is not in the pump housing. (In the preferred embodiment, there are actually two flaps that block fluid flow through the anti-free flow valve.) When the cassette is inserted into the pump, the pin distorts the elastomeric membrane to move the flap away from the inlet passage, thus allowing the medicinal fluid to flow through the anti-free flow valve, fluid flow through the pump then being controlled by the first and second inlet valves and the first and second outlet valves.

BRIEF DESCRIPTION OF THE DRAWING FIGURES

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

Figure 1:
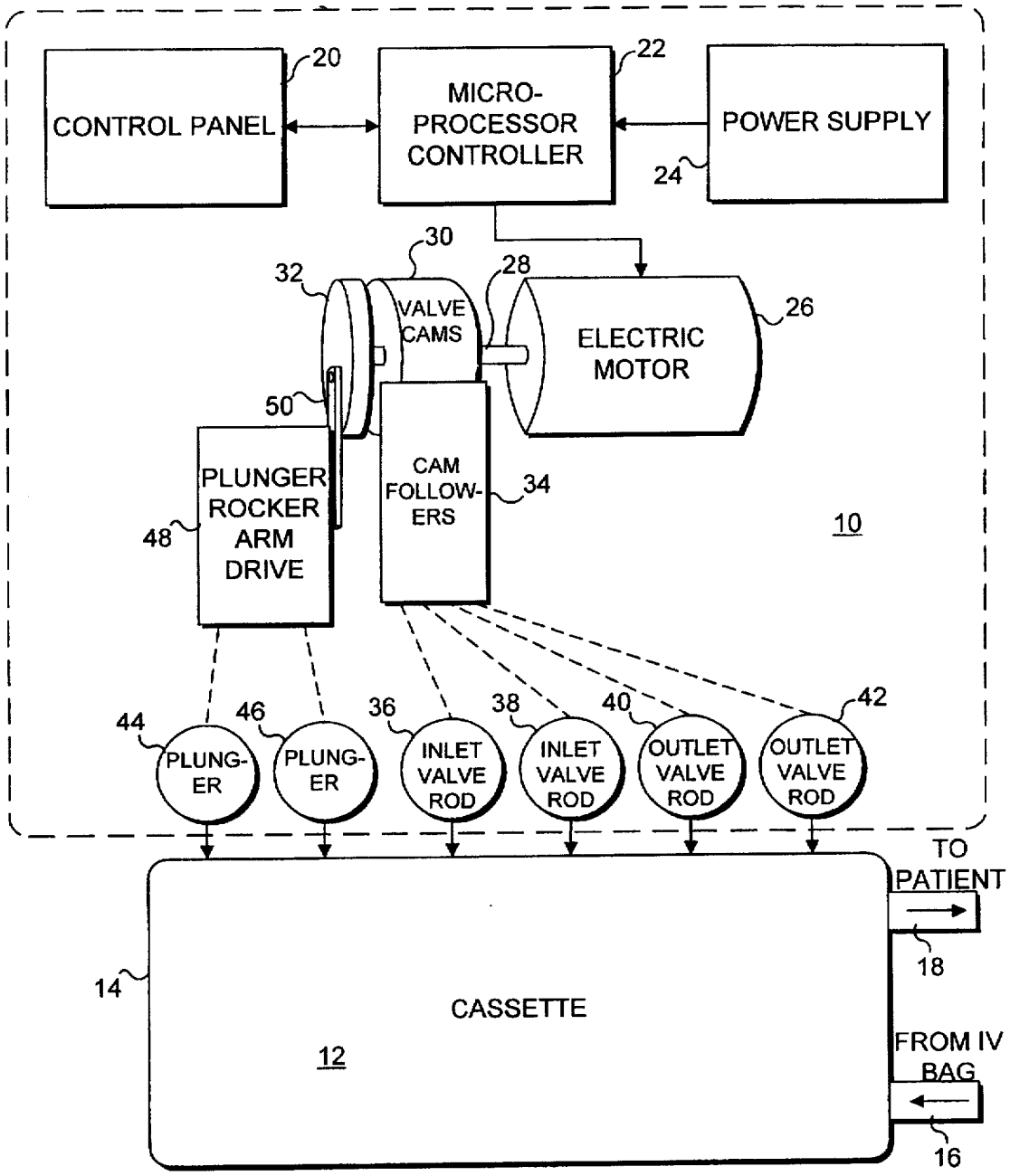
FIG. 1 is a block diagram of the cassette pump, illustrating the functional components of the pump and the cassette.

FIG. 1 is a block diagram illustrating the functional components of an intravenous (IV) pump 10, which is used in connection with a disposable cassette 12 for intravenously delivering a medicinal fluid to a patient. Cassette 12 includes a housing 14 on which is disposed an inlet port 16 for accepting the medicinal fluid flowing from an IV bag or other fluid container (not shown) through fluid lines that couple the source of medicinal fluid to the inlet port of cassette 12 (also not shown). Similarly, fluid lines (not shown) couple an outlet port 18 on housing 14 to the body of a patient. Details of pump 10 that are not discussed below can be determined by reference to commonly assigned U.S. Pat. No. 4,824,584, the disclosure and drawings of which are hereby specifically incorporated herein by reference. Where differences exist between the present invention and the prior art pump disclosed in this reference, the following discussion provides an enabling disclosure that should be relied upon instead of the disclosure in the referenced patent.

IV pump 10 includes a control panel 20 that enables a medical practitioner to select settings used to control the operation of the IV pump, including the volume of fluid to be infused, the rate of fluid infusion, and the duration during which the medicinal fluid will be delivered to the patient. Furthermore, control panel 20 includes a display (not shown) on which prompts to assist the entry of data for controlling the pump and information concerning the status of the pump are displayed. The control panel is coupled to a microprocessor controller 22 that responds to a program stored within a memory (not shown) of the microprocessor controller to control IV pump 10 in accord with the settings entered by the medical practitioner. A power supply 24, which is coupled to an AC line and includes a battery supply (neither shown) provides the appropriate voltages for operating IV pump 10. Power is supplied to microprocessor controller 22 (and to other components of the IV pump) when the IV pump is energized to enter the control settings and to pump fluid.

An electric motor 26 that is controlled by microprocessor controller 22 is energized by the power supply to serve as a prime mover for rotatably driving a shaft 28 on which are mounted valve cams 30 and a drive wheel 32. A plurality of cam followers 34 follow the peripheral surfaces of valve cams 30 so that as shaft 28 rotates, valve actuator rods 36, 38, 40, and 42 are driven by the cam followers in synchronization with the drive wheel to effect a pump cycle that forces the medicinal fluid through cassette 12.

Drive wheel 32 is pivotally coupled to a drive yoke 50 at a point offset from the center of rotation of the drive wheel, so that as the drive wheel rotates with shaft 28, drive yoke 50 reciprocates back and forth to drive a plunger rocker arm drive assembly 48. The reciprocating motion of drive yoke 50 alternately advances a first pumping plunger 44 while retracting a second pumping plunger 46 and then advances the second pumping plunger while retracting the first pumping plunger. First and second pumping plungers 44 and 46 are operative to force fluid that has entered inlet port 16 from outlet port 18 in a substantially continuous flow. In contrast, a conventional cassette that has a single pumping plunger produces pulses of fluid flow at its outlet port.

Figure 2:
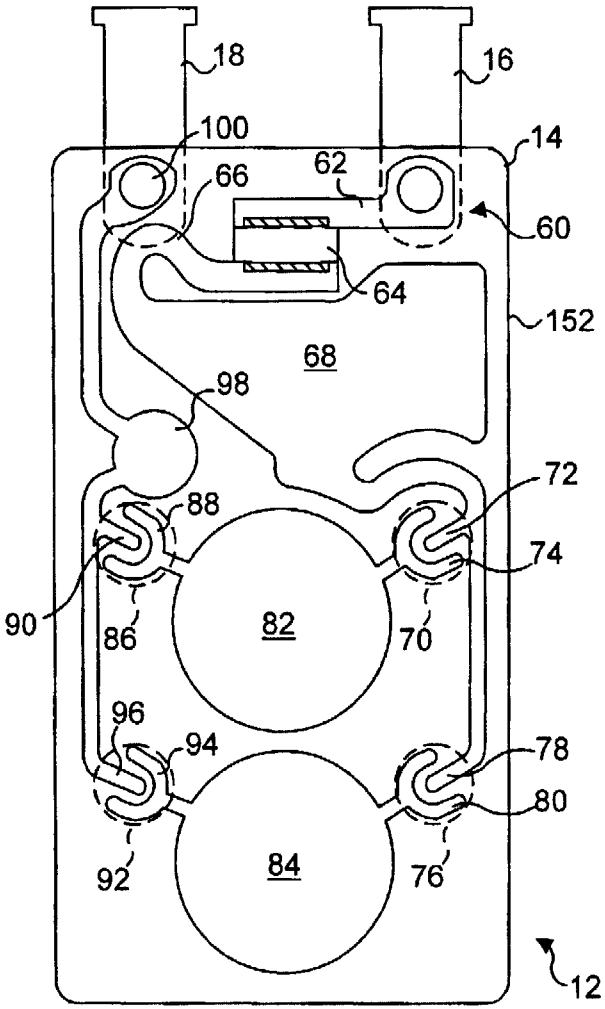
FIG. 2 is a plan view of the back section of the cassette housing, showing the passages, valves, and pumping chambers formed therein.

Referring to FIG. 2, details of a back portion 152 of cassette 12 are shown. It should be noted that housing 14 of cassette 12 comprises back portion 152 to which is sealingly attached a front portion 52 (shown in FIG. 3), using an appropriate adhesive. Sealed between front portion 52 and back portion 152 of housing 14 is an elastomeric membrane 150. Elastomeric membrane 150 serves as a seal for a fluid path 60 that extends through cassette 12 between inlet port 16 and outlet port 18 in back portion 152. Housing 14 is injection molded from a plastic material.

Fluid entering inlet port 16 travels through an inlet passage 62, but is blocked by an anti-free flow valve 64 unless cassette 12 is engaged in IV pump 10. Anti-free flow valve 64 prevents fluid flow through cassette 12 due to gravity when the cassette is not engaged with the IV pump, for example, during the set up of the pump apparatus. Once cassette 12 is latched into IV pump 10, fluid flow through the cassette along fluid path 60 is controlled by inlet valves 70 and 76, and outlet valves 86 and 92. Further details of anti-free flow valve 64 are described below.

Fluid path 60 extends from anti-free flow valve 64 through a connecting passage 66 into an air trap 68. Although not shown, a proximal air pressure sensor may be co-located within air trap 68, extending through an opening in front portion 52 to contact the elastomeric membrane, and thus, sensing the proximal pressure of the fluid being administered by IV pump 10. Cassette 12 is normally oriented within IV pump 10 so that inlet port 16 and outlet port 18 are at the top of the cassette, thereby insuring that any air bubbles in the medicinal fluid are trapped in air trap 68. Fluid path 60 proceeds from the lower portion of air trap 68 (when the cassette is vertically oriented as shown in FIG. 2), flowing into inlet valves 70 and 76, which are in parallel segments of the fluid path. Inlet valve 70 includes a stub portion 72, which is partially surrounded by a U-shaped portion 74. U-shaped portion 74 is not directly connected to stub portion 72 by passages defined within back portion 152 of housing 14. Instead, fluid flows between stub portion 72 and U-shaped portion 74 over the passage walls separating these elements of the fluid path, as described below. Similarly, inlet valve 76 includes a stub portion 78 that is partially surrounded by a U-shaped portion 80.

U-shaped portion 74 of inlet valve 70 is coupled in fluid communication with a first pumping chamber 82. In similar fashion, U-shaped portion 80 of inlet valve 76 is coupled in fluid communication with a second pumping chamber 84. Fluid flowing through cassette 12 exits first pumping chamber 82 into an outlet valve 86 that comprises a U-shaped portion 88 and a stub portion 90. Fluid exiting second pumping chamber 84 flows into outlet valve 92, which includes a U-shaped portion 94 partially surrounding a stub portion 96. Fluid flow between U-shaped portions 88 and 94, and corresponding respective stub portions 90 and 96 is controlled by the force exerted against the elastomeric membrane over the outlet valves, just like inlet valves 70 and 76. After passing through outlet valves 86 and 92, fluid flows into a distal pressure sensor chamber 98, and then through an outlet passage 100 into outlet port 18.

Figure 3:
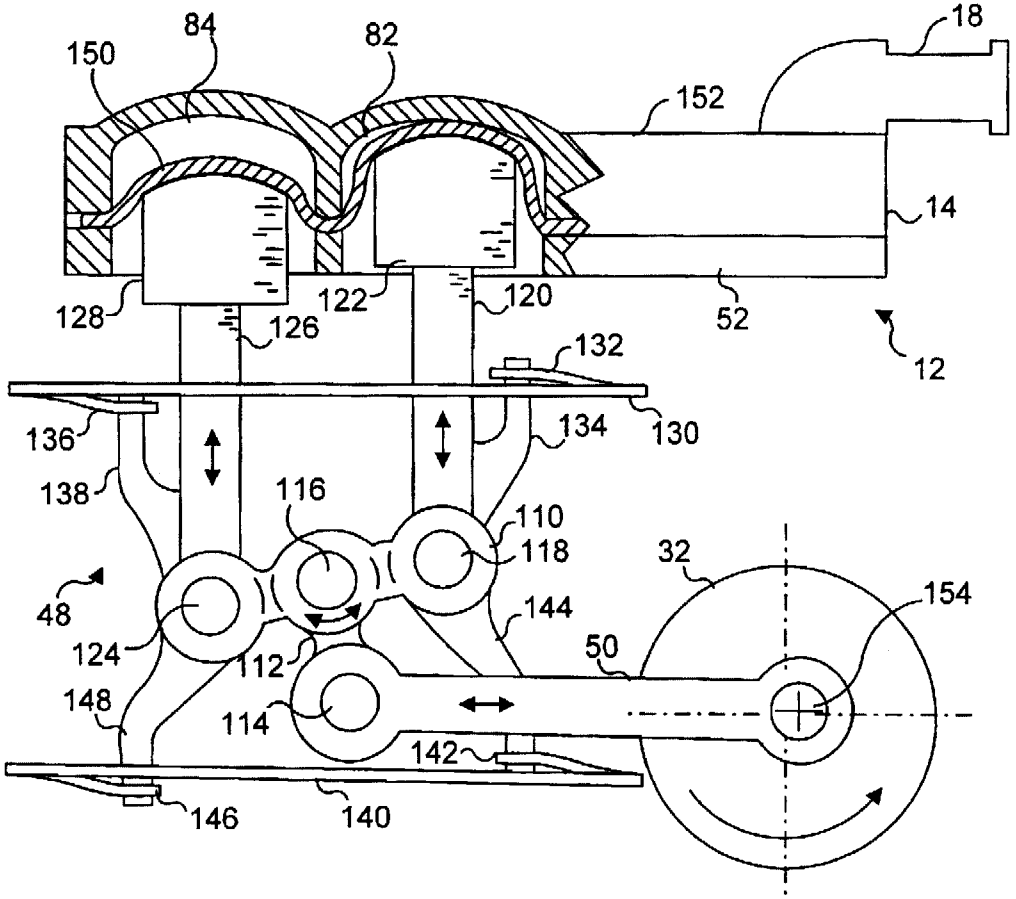
FIG. 3 is a cutaway side view of the cassette, illustrating the pumping chambers formed therein, and a side view of the rocker arm assembly and pumping plungers that force fluid from the pumping chambers.
Figure 4:
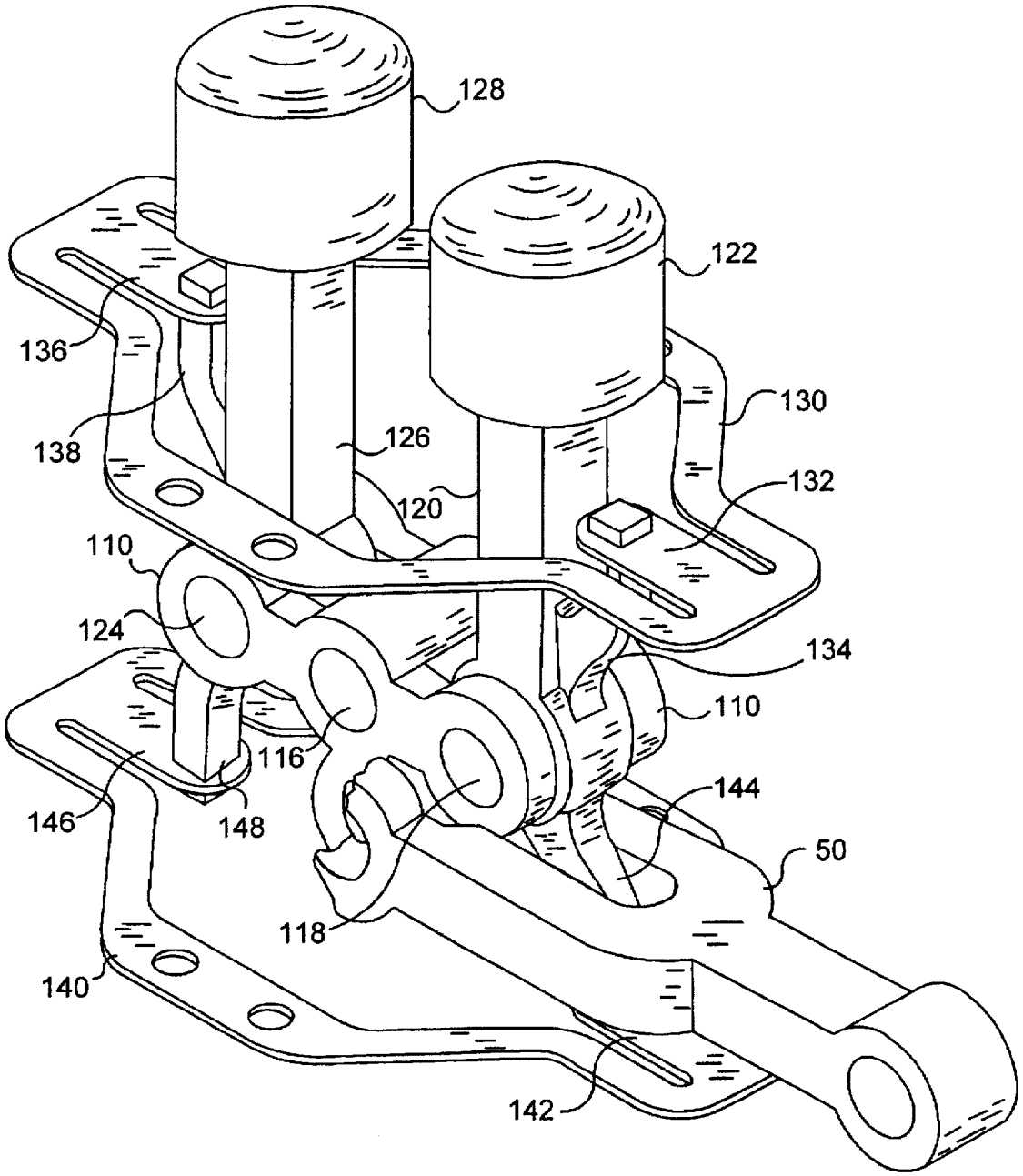
FIG. 4 is an isometric view of the rocker arm assembly of FIG. 3, with the drive yoke partially cut away for clarity.

Elastomeric membrane 150 comprises one side of first pumping chamber 82 and of second pumping chamber 84, and as shown in FIG. 3, is forced into these pumping chambers to displace fluid contained therein. Displacement of elastomeric membrane 150 into first and second pumping chambers 82 and 84 is accomplished in response to the reciprocating action of plunger rods 120 and 126, respectively. At one end of plunger rod 120 is disposed a first pumping plunger 122, and at a corresponding end of plunger rod 126 is disposed a second pumping plunger 128. First pumping plunger 122 is reciprocatively driven so as to displace elastomeric membrane 150 fully into first pumping chamber 82, and second pumping plunger 128 is driven 180° out of phase with the first pumping plunger, to displace elastomeric membrane 150 fully into second pumping chamber 84. As shown in FIGS. 3 and 4, the reciprocating motion that applies the driving force for displacing elastomeric membrane 150 in this manner is supplied through rocker arm drive 48.

Plunger rods 120 and 126 are pivotally attached to a rocker arm 110 on pivot shafts 118 and 124, respectively.

Rocker arm 110 pivots back and forth around a pivot shaft 116 in response to a reciprocating drive force applied through drive yoke 50 that is supplied by the rotation of drive wheel 32. One end of drive yoke 50 is coupled to drive wheel 32 through a pivot 154, which is offset from the center of rotation of drive wheel 32 (on shaft 28, as shown in FIG. 1). The other end of drive yoke 50 connects to a drive arm 112, which extends below pivot shaft 116, on rocker arm 110. Drive arm 112 connects to drive yoke 50 through a pivot shaft 114. Thus, as drive yoke 50 reciprocates back and forth, the reciprocating motion of the drive yoke moves pivots shafts 118 and 124 up and down (see FIG. 3).

Support for rocker arm drive 48 is provided by an upper spring plate 130 and a lower spring plate 140. Upper spring plate 130 is coupled to a knee 134, which is attached on one side of plunger rod 120, through a flexure 132. A lower portion 144 of plunger rod 120 is similarly connected to lower spring plate 140 via a flexure 142. Likewise, plunger rod 126 includes a knee 138 on one side that is coupled to a flexure 136 on upper spring plate 130; a lower portion 148 of plunger rod 126 is connected to a flexure 146 on lower spring plate 140. As rocker arm 110 reciprocates back and forth, flexures 132, 136, 142, and 146 are alternately displaced above and below upper and lower spring plates 130 and 140, respectively. This displacement offsets the flexures from their normal position. During every stroke of drive yoke 50, fluid is forced from the cassette. The inlet stroke for the first pumping chamber corresponds to the pumping stroke for the second pumping chamber and vice versa. Pump 10 is more efficient than a conventional cassette pump because the force exerted by the elastomeric diaphragm that is displaced into one of the pumping chambers acts through the rocker arm drive to force the other pumping plunger into the other pumping chamber. If allowed to return to an equilibrium position, both pumping plungers would be partially inside their respective pumping chambers, with the elastomeric membrane under tension and slightly displaced inside each of the pumping chambers.

It should be noted that when cassette 12 is engaged in IV pump 10, first and second pump plungers 122 and 128 partially displace elastomeric membrane 150 into corresponding pumping chambers 82 and 84. Consequently, the portion of the elastomeric membrane that covers the pumping chambers is continually under tension as first and second pumping plungers 122 and 128 move between the limits of their reciprocating motion. The tension of elastomeric membrane 150 against first and second pumping plungers 122 and 128 insures that the elastomeric membrane remains in contact with the pumping plungers throughout the pumping cycle. In FIG. 3, second pumping plunger 128 is illustrated when it is approximately at its most retracted position, whereas first pumping plunger 122 is shown when it is approximately fully displaced into pumping chamber 82. However, it will be noted that elastomeric membrane 150 remains in contact with second pumping plunger 128 and is elastomerically distorted and forced part-way into pumping chamber 84, even though second pumping plunger 128 is approximately in its maximum retracted position.

Figure 5:
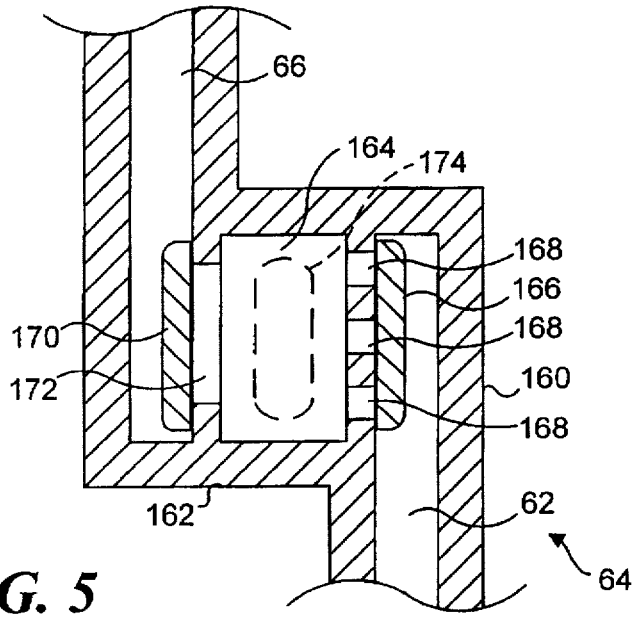
FIG. 5 is a plan section view of an anti-free flow valve in the cassette, showing the valve in its normal closed condition.
Figure 6:
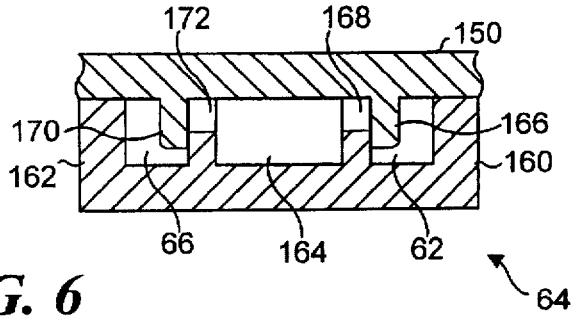
FIG. 6 is an end section view of the anti-free flow valve in its normal closed condition (before the cassette is inserted into the pump)
Figure 7:
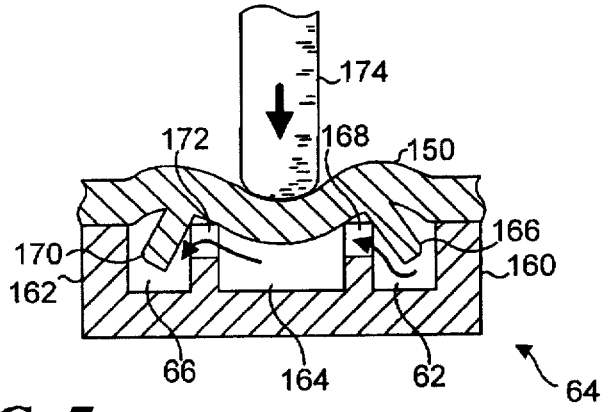
FIG. 7 is an end section view of the anti-free flow valve, in the open condition achieved by inserting the cassette into the pump.

In FIGS. 5–7, details of anti-free flow valve 64 are illustrated. FIG. 5 shows the anti-free flow valve in its normally closed position in which free fluid flow through fluid passage 60 is blocked. In the anti-free flow valve, walls 160 and 162, which are formed on back portion 152 of housing 14, define inlet passage 62 and connecting passage 66. In addition, walls 160 and 162 define a plurality of inlet passages 168 into a small chamber 164, and an outlet passage 172 from the chamber. As shown in FIG. 5, a pair of downwardly depending flaps 166 and 170 on elastomeric membrane 150 respectively block inlet passages 168 and outlet passage 172, when cassette 12 is not engaged with or inserted into IV pump 10. The pressure of the fluid due to gravity acting on the upstream surface of flap 166 helps to insure that it seals against the periphery of inlet passages 168. FIG. 6 shows anti-free flow valve 64 in cross-sectional view, illustrating the manner in which flaps 166 and 170 are sealingly disposed on the upstream side of inlet passages 168 and on the downstream side of outlet passage 172, respectively.

In FIG. 7, anti-free flow valve 64 is shown in its open condition. When cassette 12 is engaged in IV pump 10, a pin or bar 174 that is fixed in IV pump 10 displaces elastomeric membrane 150 into chamber 164. In FIG. 5, the cross-sectional shape of bar 174 and its position over chamber 164 is shown by dash lines. Displacement of elastomeric membrane 150 by the rounded end of bar 174 distorts the elastomeric membrane, forcing flaps 166 and 170 away from respective inlet passages 168 and outlet passage 172 and enabling fluid to flow through chamber 164. Anti-free flow valve 64 remains in the open condition shown in FIG. 7 so long as cassette 12 is engaged by IV pump 10.

Figure 8:
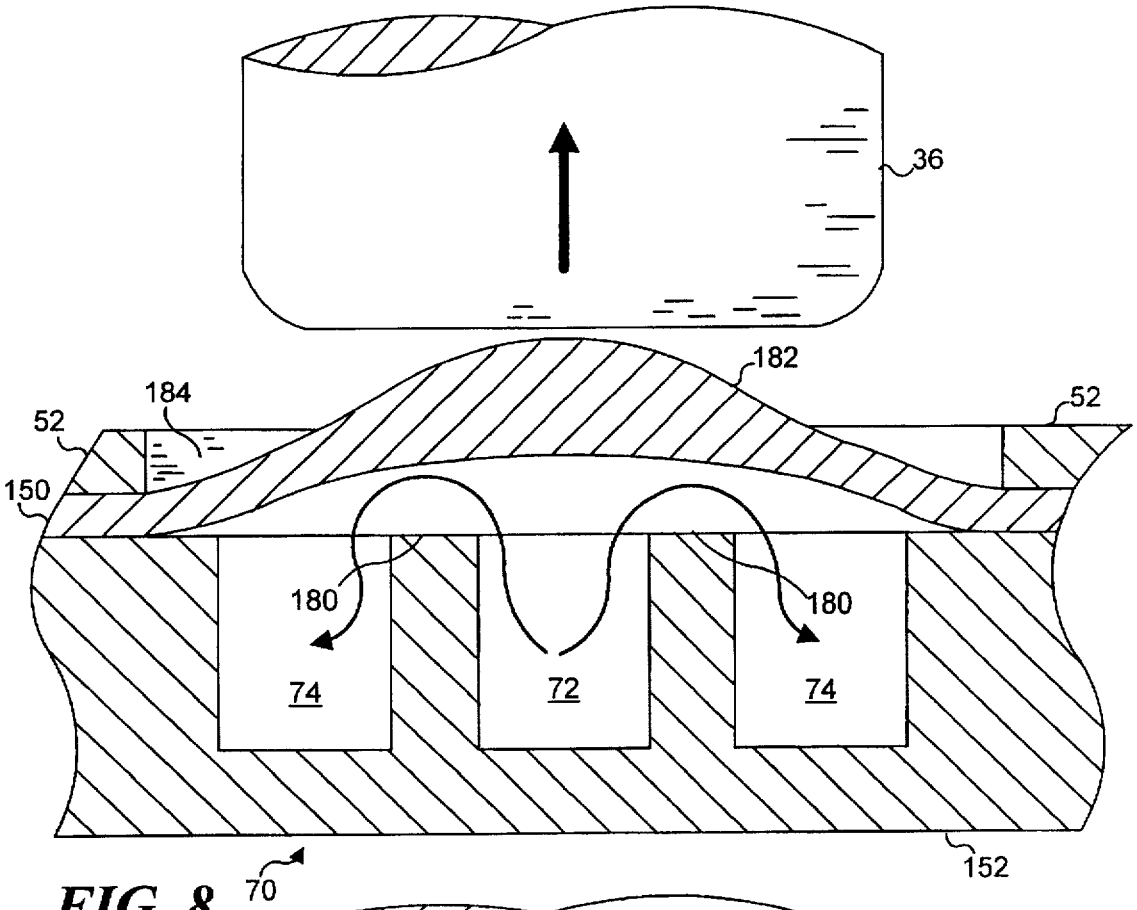
FIG. 8 is a sectional view of one of the inlet valves in a fully open mode.
Figure 9:
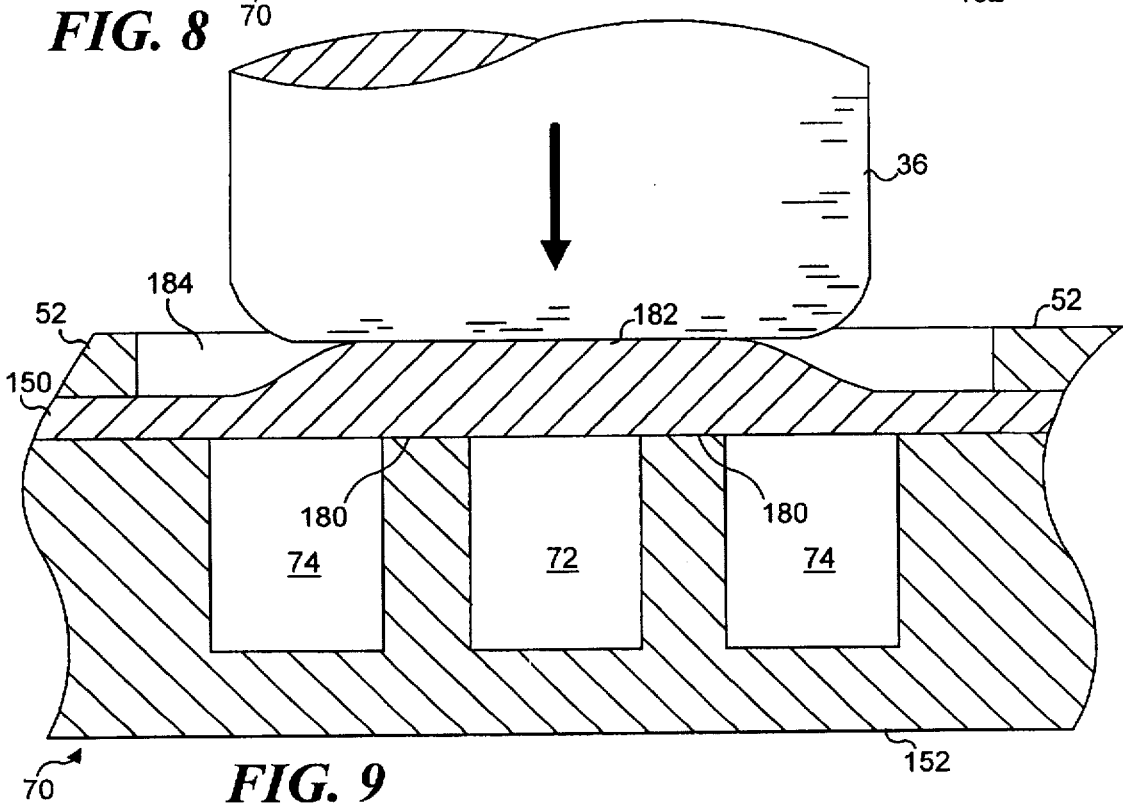
FIG. 9 is a sectional view of the inlet valve of FIG. 8, showing the valve in a fully closed mode.
Figure 11:
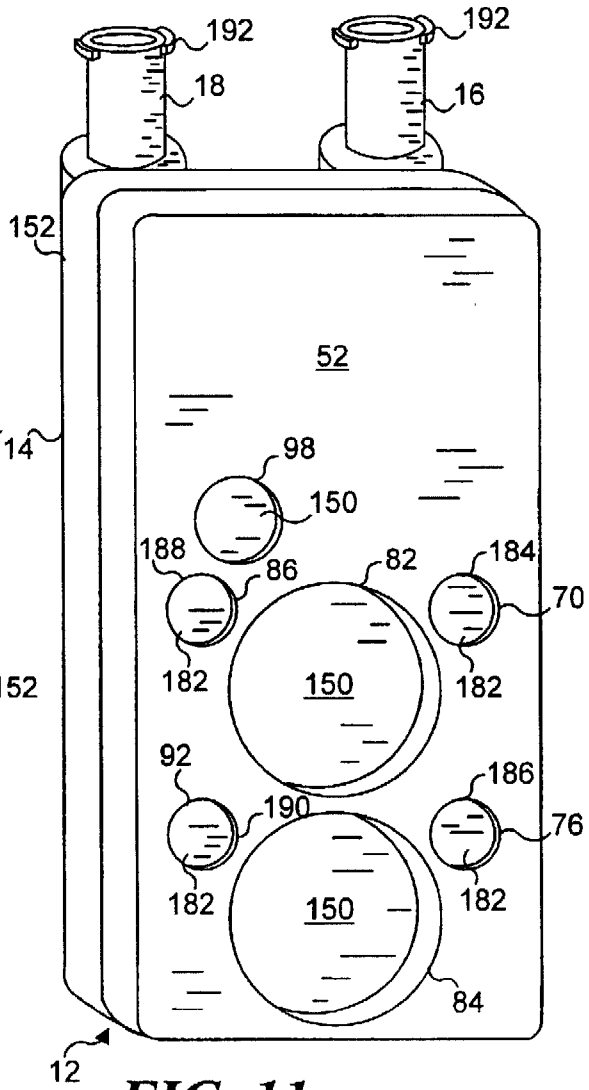
FIG. 11 is an isometric elevational view of the cassette, showing the apertures in a front portion of the cassette through which an elastomeric membrane is exposed.
Figure 10:
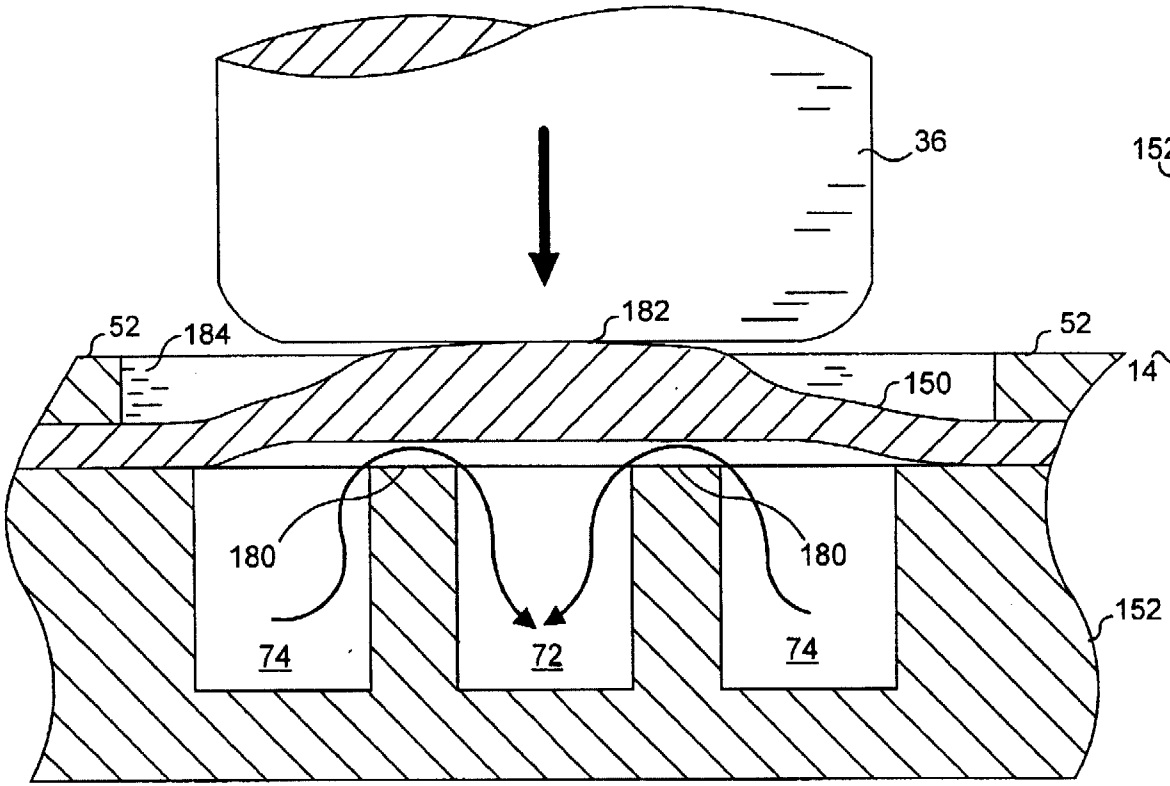
FIG. 10 is a sectional view of the inlet valve of FIG. 8, showing the valve in a cracking mode.

Three operating conditions of inlet valve 70 are illustrated in FIGS. 8, 9, and 10. FIG. 8 shows inlet valve 70 in a fully open condition that enables fluid to flow freely from stub portion 72 into U-shaped portion 74 over a sealing surface 180, which is disposed on the top of the walls in back portion 152 that separate the stub portion from the U-shaped portion. When the inlet valves are fully open, elastomeric membrane 150 assumes a position that provides a clear fluid path over sealing surface 180, between the stub portion and U-shaped portion as shown in FIG. 8. When inlet valve 70 is thus fully open, valve actuator rod 36 is either clear of or just touching, but not providing any force against a thickened section 182 of elastomeric membrane 150 that is disposed over sealing surfaces 180.

FIG. 9 shows inlet valve 70 in a fully closed condition wherein valve actuator rod 36 has moved from the position shown in FIG. 8 to exert a substantial force against thickened portion 182 of elastomeric membrane 150, forcing its undersurface into contact with sealing surfaces 180. Thickened portion 182 is fully exposed through an opening 184 in top portion 52 of case 14. The force exerted by valve actuator rod 36 causes the undersurface of elastomeric membrane 150 to completely seal the fluid path between stub portion 72 and U-shaped portion 74, interrupting fluid flow between these portions. Thickened portion 182 is provided on elastomeric membrane 150 over each of the inlet and outlet valves to more completely distribute force applied by the valve actuator rods over sealing surface 180.

Finally, as shown in FIG. 10, valve actuator rod 36 applies a lesser force (cracking force) against thickened portion 182. This cracking force is predetermined to correspond to a desired cracking pressure in the first pumping chamber. So long as the force developed by the pressure of fluid in U-shaped portion 74 is less than the cracking force exerted by the valve actuator rod, the undersurface of elastomeric membrane 150 will contact sealing surfaces 180, interrupting fluid flow between U-shaped portion 74 and stub portion 72 in the valve. However, once the fluid pressure within U-shaped portion 74 develops a force that exceeds the cracking force, elastomeric membrane 150 is pushed away from sealing surfaces 180, enabling fluid that has been pressurized in the first pumping chamber to flow back toward inlet port 16. This reverse flow of fluid from the first pumping chamber toward the inlet port compensates for any pressure variations that may exist in the fluid proximal (i.e., upstream) of the first pumping chamber.

Although the drawings only show details of inlet valve 70, the same configuration and the same three modes of operation—fully opened, fully closed, and cracking—also apply to inlet valve 76. Outlet valves 86 and 92 can also function in a fully closed mode, and a cracking mode to compensate for variations in the outlet pressure. However, there is less advantage for providing a cracking mode of operation for the outlet valves than there is in connection with the inlet valves, since there is typically very little variation in the distal pressure (downstream of the pumping chambers). Accordingly, for the preferred embodiment, outlet valves 86 and 92 operate in either a fully opened mode that enables fluid displaced from pumping chambers 82 and 84 to flow through outlet port 18, or a fully closed mode, which is used while inlet valves 70 and 76 are operating in the cracking mode.

A pumping cycle in cassette 12 thus proceeds as follows. During an inlet stroke, first pumping plunger 122 retracts from its fully extended position within pumping chamber 82. As the retraction of the pumping plunger occurs, outlet valve 86 is closed and inlet valve 70 is fully open, enabling fluid flowing through inlet port 16 to travel along the fluid path in cassette 12 and into pumping chamber 82. First pumping plunger 122 then begins to force elastomeric membrane 150 further into pumping chamber 82. During an initial portion of this pumping stroke, outlet valve 86 remains closed and inlet valve 70 transitions from the fully open mode to the cracking mode, wherein the inlet valve is initially closed, but opens as the pressure within pumping chamber 82 exceeds the cracking pressure exerted by valve actuator rod 36. Outlet valve 86 then opens, and inlet valve 70 fully closes, enabling the displacement of elastomeric membrane 150 by first pumping plunger 122 to displace substantially all of the fluid within pumping chamber 82, forcing the fluid through outlet port 18. If outlet valve 86 were operated in a cracking mode (instead of the fully open mode) at this time, the fluid in the pumping chamber would be forced past the outlet valve only when the pressure of the fluid exceeded a cracking force exerted by valve actuator rod 40 on outlet valve 86. By using a cracking mode on outlet valve 86 (and outlet valve 92) instead of a fully open mode, the effect of variations in the distal pressure on the rate of fluid delivered to the patient would be minimized.

As first pumping plunger 122 is completing its pumping stroke into chamber 82, second pumping plunger 128 is completing its intake stroke to enable fluid to fill chamber 84. Thereafter, first pumping plunger 122 begins its intake stroke, while second pumping plunger 128 begins its pumping stroke. Inlet valve 76 changes to the cracking mode and outlet valve 92 remains closed. If the fluid pressure within pumping chamber 84 exceeds the predetermined cracking pressure due to the cracking force exerted by valve actuator rod 38, inlet valve 76 is forced open, enabling fluid to flow back toward inlet port 16. Subsequently, as the cycle proceeds, inlet valve 76 fully closes, and outlet valve 92 fully opens so that fluid is forced from pumping chamber 84 by the continued displacement of elastomeric membrane 150 into the pumping chamber due to the movement of second pumping plunger 128. Accordingly, fluid flow through outlet port 18 remains relatively continuous as a result of the displacement of the fluid from pumping chamber 82, and then from pumping chamber 84. As noted above, outlet valve 92 can be operated in the cracking mode instead of the fully open mode to minimize the effect of variations in the distal pressure on the rate of flow from the pump.

Figure 12:
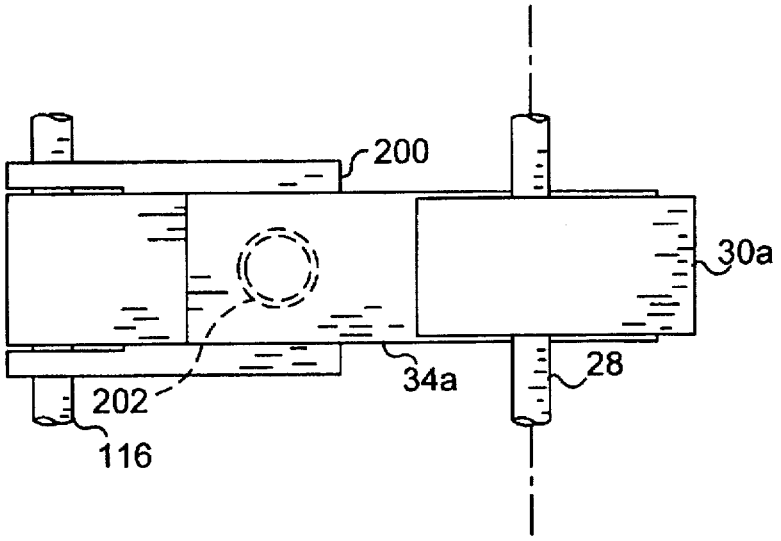
FIG. 12 is a plan view of a valve cam and cam follower assembly for one of the inlet valves.
Figure 13:
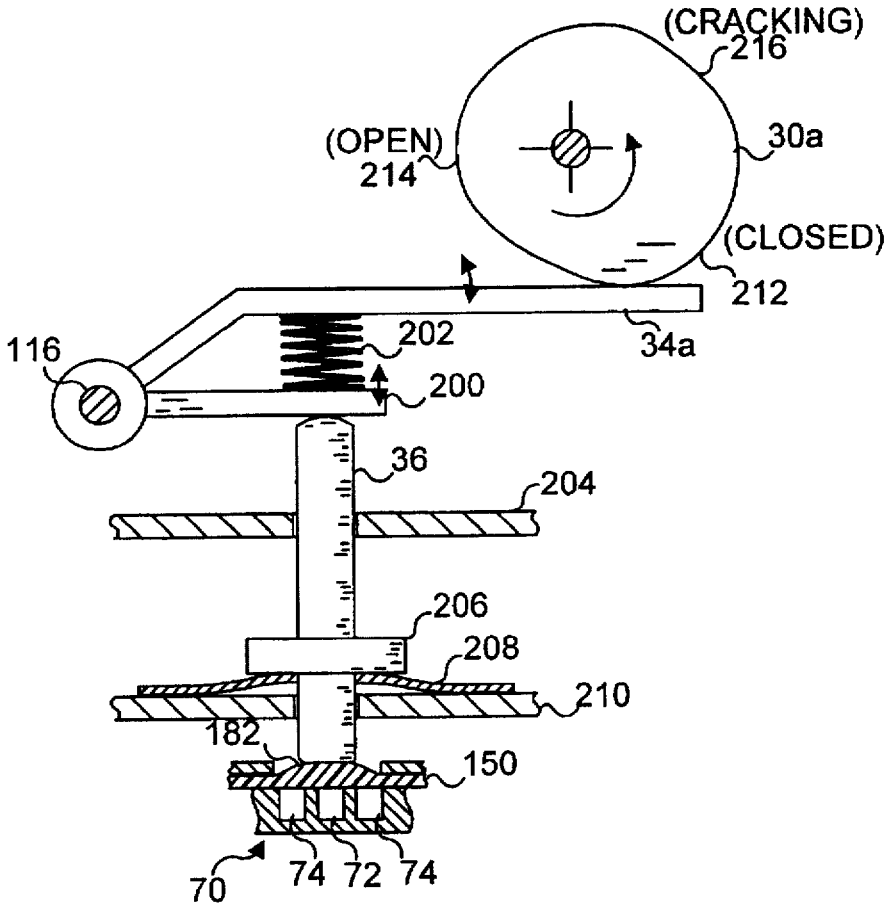
FIG. 13 is a side elevational view of the valve cam, cam follower assembly, valve actuator rod, and inlet valve (the remainder of the cassette and pump having been cut away to simplify the view).

FIGS. 12 and 13 illustrate how a valve cam 30a (one of four valve cams 30) is used to actuate inlet valve 70 in the three modes in which the inlet valve operates. Valve cam **30*a* has three sectors that contact a cam follower 34*a*, including a sector 212 corresponding to the fully closed mode of inlet valve 70, a sector 214 corresponding to the fully open mode of the inlet valve, and a sector 216 corresponding to the cracking mode of the inlet valve. From FIG. 13, it will be noted that sector 212 is at a maximum distance from the center of rotation of the valve cam, sector 214 is radially closest to the center of rotation, and sector 216** is intermediate in its radial displacement from the center of rotation.

Cam follower **34*a* rides along the peripheral surface of valve cam 30*a*. The valve cam applies a force against valve cam follower 34*a* that is proportional to the radial displacement of the peripheral surface of the valve cam from the center of rotation. Cam follower 34*a* pivots about a pivot shaft 116, as does a lever 200. Disposed between opposite surface of lever 200 and valve cam follower 34*a* is a helical spring 202. As valve cam follower 34*a* is forced toward lever 200, compression of helical spring 202 increases, thereby increasing the force exerted by the spring against lever 200. The force exerted by helical spring 202 against lever 200 is applied against one end of valve actuator rod 36. The valve actuator rod transmits the force against thickened portion 182 of elastomeric membrane 150 during the cracking mode and fully closed modes of inlet valve 70**.

Valve actuator rod 36 extends through plates 204 and 210. A retainer flange 206 formed on valve actuator rod 36 between plates 204 and 210 rides against a Bellville spring 208, which tends to force the valve actuator rod away from thickened portion 182 of elastomeric membrane 150. The spring force provided by Bellville spring 208 is only sufficient to enable valve actuator rod 36 to withdraw away from elastomeric membrane 150 so that the valve can achieve its fully open condition when the force exerted by helical coiled spring 202 is at its minimum because valve cam **30*a* has rotated to bring section 214 to bear against cam follower 34*a*. As the cam rotates to bring section 216 to bear against cam follower 34*a*, the force exerted by helical spring 202 increases, thereby applying a cracking force through valve actuator rod 36 against elastomeric membrane 150. Continued rotation of valve cam 30*a* again brings section 212 to bear against cam follower 34*a*, increasing the force exerted by helical coiled spring 202 until valve 70** is fully closed.

Inlet valve 76 operates in a similar fashion, using a valve cam (not separately shown) that is offset 180° relative to valve cam **30*a*. Similarly, outlet valves 86 and 92 are actuated using valve cams 30** that each have only two lobes, including a lobe or section (not shown) corresponding to the fully open (or alternatively, the cracking) mode of the outlet valve, and a second lobe or section at a substantially greater radial distance from the center of rotation of the valve cam, which corresponds to the fully closed mode of the outlet valve.

It will be apparent that many other techniques for applying force to elastomeric membrane 150 to operate the inlet and outlet valves in their various modes can be employed besides that disclosed in the preferred embodiment. For example, a leaf spring could be used to apply the force acting upon the valve actuator rods in response to the rotational position of the valve cams.

Although the present invention has been described in connection with the preferred form of practicing it and variations thereon, those of ordinary skill in the art will understand that many other modifications can be made thereto within the scope of the claims that follow. Accordingly, it is not intended that the scope of the invention in any way be limited by the above description, but instead be determined entirely by reference to the claims that follow.

The invention in which an exclusive right is claimed is defined by the following:

1. A cassette for use in a medical pump, comprising:

(a) a housing having an inlet port and an outlet port, said housing including a front portion and a rear portion between which is sealed an elastomeric membrane that cooperates with the housing to define a fluid path within the housing, between the inlet port and the outlet port, said fluid path including two parallel flow segments;

(b) two pumping chambers disposed in the parallel flow segments of the fluid path, one side of each pumping chamber comprising a different portion of the elastomeric membrane;

(c) a plurality of valves disposed in the parallel flow segments of the fluid path to control fluid flow into and out of the pumping chambers, a repetitive displacement of the elastomeric membrane into the pumping chambers in sequence forcing fluid from the pumping chambers and through the outlet port in a continuous flow; and (d) said elastomeric membrane being partially displaced into the two pumping chambers when the cassette is inserted into the pump to ensure that the different portions of the elastomeric membrane comprising said one side of each of said pumping chambers are always under tension during the repetitive displacement of the elastomeric membrane.

2. A cassette for use in a pump that delivers a medicinal fluid in a substantially continuous flow, comprising:

(a) a housing having an inlet port through which the medicinal fluid enters the cassette and an outlet port through which the medicinal fluid leaves the cassette, said housing providing a sealed fluid path between the inlet port and the outlet port;

(b) an elastomeric membrane disposed within the housing and cooperating with the housing to define the fluid path between the inlet port and the outlet port;

(c) a first pumping chamber and a second pumping chamber formed in the housing, said first and second pumping chambers being in the fluid path, in parallel relationship to each other, and being defined in part by the elastomeric membrane;

(d) a first inlet valve and a second inlet valve, said first inlet valve being disposed in the fluid path between the inlet port and the first pumping chamber, and said second inlet valve being disposed in the fluid path in parallel with the first inlet valve, between the inlet port and the second pumping chamber, both said first and second inlet valves being covered by said elastomeric membrane;

(e) a first outlet valve and a second outlet valve, said first outlet valve being disposed in the fluid path between the first pumping chamber and the outlet port, and said second outlet valve being disposed in the fluid path in parallel with the first outlet valve, between the second pumping chamber and the outlet port, both said first and second outlet valves being covered by said elastomeric membrane, wherein said first and the second outlet valves comprise cracking valves that operate in a cracking mode and a fully closed mode, said first and second inlet valves opening while operating in the cracking mode when a pressure of the medicinal fluid in the respective first and second pumping chambers exceeds a predetermined cracking pressure during a portion of a pumping cycle when the elastomeric membrane is substantially displaced into the respective first and second pumping chambers; and (f) said housing having openings formed therein at a plurality of locations, including over the first and the second pumping chambers, over the first and the second inlet valves, and over the first and the second outlet valves, said elastomeric membrane being exposed through said plurality of openings, for actuation by the pump during the pumping cycle, wherein:

(i) while the first inlet valve is closed and the first outlet valve is open, medicinal fluid in the first pumping chamber is forced therefrom by displacement of the elastomeric membrane into the first pumping chamber by the pump;

(ii) as the medicinal fluid is forced from the first pumping chamber, and while the second inlet valve is open and the second outlet valve is closed, the second pumping chamber fills with the medicinal fluid flowing along the fluid path from the inlet port;

(iii) thereafter, while the second inlet valve is closed and the second outlet valve is open, the medicinal fluid in the second pumping chamber is forced therefrom by displacement of the elastomeric membrane into the second pumping chamber by the pump; and (iv) as the medicinal fluid is forced from the second pumping chamber, and while the first inlet valve is open and the first outlet valve is closed, the first pumping chamber fills with the medicinal fluid flowing along the fluid path from the inlet port, said pumping cycle repeating to produce the continuous flow of medicinal fluid from the outlet port.

3. The cassette of claim 2, further comprising an anti-free flow valve disposed in the fluid path, said anti-free flow valve blocking the fluid path until the cassette is inserted into the pump.

4. The cassette of claim 3, wherein the anti-free flow valve comprises:

(a) a chamber formed in the fluid path of the housing and having an inlet and an outlet; and (b) a flap depending from the elastomeric membrane and covering the inlet of the chamber to block the fluid path, insertion of the cassette into the pump deflecting the flap away from the inlet of the chamber to open the fluid path.

5. The cassette of claim 2, wherein the first and the second inlet valves comprise cracking valves that operate in a cracking mode, a fully open mode, and a fully closed mode, said first and second inlet valves opening while operating in the cracking mode when a pressure in the respective first and second pumping chambers exceeds a predetermined cracking pressure during a portion of the pumping cycle in which the elastomeric membrane is initially displaced into the respective first and second pumping chambers.

6. The cassette of claim 5, wherein each of the first and the second inlet valves comprises two adjacent passages formed in the housing, a bypass path between said two adjacent passages being sealed by the elastomeric membrane except when the pressure of the medicinal fluid in the first and the second pumping chambers exceeds the cracking pressure, so that the elastomeric membrane is forced away from an underlying surface of the housing that is disposed between the adjacent passages, thereby enabling the medicinal fluid to flow from one of the adjacent passages to the other via the bypass path formed between the underlying surface and the elastomeric membrane.

7. The cassette of claim 2, wherein each of the first and the second outlet valves comprises two adjacent passages formed in the housing, a bypass path between said two adjacent passages being sealed by the elastomeric membrane except when the pressure of the medicinal fluid in the first and the second pumping chambers exceeds the cracking pressure exerted by the elastomeric membrane on the first and second outlet valves, so that the elastomeric membrane is forced away from an underlying surface of the housing that is disposed between the adjacent passages, thereby enabling the medicinal fluid to flow from one of the adjacent passages to the other via the bypass path formed between the underlying surface and the elastomeric membrane.

8. The cassette of claim 2, wherein the elastomeric membrane is partially displaced into the first and second pumping chambers when the cassette is inserted into the pump to ensure that portions of the elastomeric membrane defining one side of each of the first and second pumping chambers are always under tension during the entire pumping cycle.

9. The cassette of claim 2, further comprising an air trap chamber formed in the housing and disposed in the fluid path between the inlet port and the first and second inlet valves.

10. The cassette of claim 2, further comprising a distal pressure sensing point disposed downstream of the first and second outlet valves.

11. The cassette of claim 2, wherein the housing comprises a front and a back, said elastomeric membrane being sealingly engaged between the front and the back.

12. A cassette pump for delivering a continuous flow of a medicinal fluid to a patient, comprising:

(a) a cassette that includes:

(i) a sealed housing having an inlet port through which the medicinal fluid is supplied to the cassette, and an outlet port through which the medicinal fluid is delivered to the patient after being conveyed through the housing along a fluid path from the inlet port;

(ii) a first pumping chamber disposed in the fluid path between a first inlet valve and a first outlet valve;

(iii) a second pumping chamber disposed in the fluid path between a second inlet valve and a second outlet valve, in parallel with the first pumping chamber; and (iv) an elastomeric membrane sealed inside said housing, covering the first and second pumping chambers, the first and second inlet valves, and the first and second outlet valves, said housing including a plurality of openings through which the elastomeric membrane is exposed at the first and second pumping chambers, the first and second inlet valves, and the first and second outlet valves;

(b) a pump housing for receiving the cassette;

(c) a prime mover, disposed within the pump housing, drivingly coupled to a first pump plunger and a second pump plunger for successively displacing the elastomeric membrane respectively into the first pumping chamber and second pumping chamber, displacement of the elastomeric membrane into said pumping chambers forcing the medicinal fluid therefrom; and (d) a plurality of valve actuators drivingly coupled to the prime mover to apply force to said elastomeric membrane through the openings in the housing of the cassette at the first and second inlet valves and at the first and second outlet valves, to open and close the first and second inlet valves and the first and second outlet valves during a pumping cycle in synchronization with the displacement of the first and second pump plungers respectively into the first and second pumping chambers, repetitive displacement of the medicinal fluid from one of the first and second pumping chambers by the elastomeric membrane followed by displacement of the medicinal fluid from the other of the first and second pumping chambers by the elastomeric membrane producing the continuous flow of the medicinal fluid from the outlet port.

13. The cassette pump of claim 12, wherein the prime mover is coupled to the first and second pump plungers by a linkage that includes a rocker arm having opposite ends coupled to the first and second plunger and being driven to rock back and forth so as to reciprocatively move the first and second pump plungers by a yoke that extends between the rocker arm and a drive wheel, said drive wheel being rotated about a center of rotation by the prime mover, and said yoke being pivotally coupled to a point on the drive wheel that is offset from the center of rotation of the drive wheel.

14. The cassette pump of claim 12, wherein the first and second inlet valves are cracking valves that operate in a fully open mode, a fully closed mode, and a cracking mode, operation in said cracking mode enabling the medicinal fluid to flow back toward the inlet port when a pressure of the medicinal fluid within a respective one of the first and second pumping chambers exceeds a predetermined cracking pressure during an initial displacement of the elastomeric membrane into the respective one of the first and second pumping chambers, thereby minimizing any effect of a variation in a pressure of the medicinal fluid at the inlet port on a flow rate of the medicinal fluid delivered from the outlet port.

15. The cassette pump of claim 12, wherein the first and second outlet valves are cracking valves that operate in a fully closed mode and a cracking mode, operation in said cracking mode enabling the medicinal fluid to flow toward the outlet port when a pressure of the medicinal fluid within a respective one of the first and second pumping chambers exceeds a predetermined cracking pressure during a substantial displacement of the elastomeric membrane into the respective one of the first and second pumping chambers, thereby minimizing any effect of a variation in a pressure of the medicinal fluid at the outlet port on a flow rate of the medicinal fluid delivered from the outlet port.

16. The cassette pump of claim 12, further comprising a distal pressure sensor for monitoring a pressure of the medicinal fluid delivered from the output port.

17. The cassette pump of claim 12, wherein the first and second pump plungers depress the elastomeric membrane part way into the first and second pumping chambers when the cassette is inserted into the pump housing.

18. The cassette pump of claim 12, further comprising an anti-free flow valve disposed between the inlet port and the first and second inlet valves, said anti-free flow valve blocking fluid flow through the cassette until the cassette is engaged by the valve actuators.

19. The cassette pump of claim 18, further comprising a pin that opens the anti-free flow valve when the cassette is inserted into the pump housing.

20. The cassette pump of claim 19, wherein the anti-free flow valve comprises a chamber formed in the housing of the cassette and having an inlet passage, said inlet passage being blocked by a flap that depends from the elastomeric membrane and covers the inlet passage into the chamber while the cassette is not in the pump housing, said pin distorting the elastomeric membrane to move the flap away from the inlet passage to allow the medicinal fluid to flow through the anti-free flow valve after the cassette is inserted into the pump housing.

21. A cassette for use in a pump that delivers a medicinal fluid in a substantially continuous flow, comprising:

(a) a housing having an inlet port through which the medicinal fluid enters the cassette and an outlet port through which the medicinal fluid leaves the cassette, said housing providing a sealed fluid path between the inlet port and the outlet port;

(b) an elastomeric membrane disposed within the housing and cooperating with the housing to define the fluid path between the inlet port and the outlet port;

(c) a first pumping chamber and a second pumping chamber formed in the housing, said first and second pumping chambers being in the fluid path, in parallel relationship to each other, and being defined in part by portions of the elastomeric membrane;

(d) a first inlet valve and a second inlet valve, said first inlet valve being disposed in the fluid path between the inlet port and the first pumping chamber, and said second inlet valve being disposed in the fluid path in parallel with the first inlet valve, between the inlet port and the second pumping chamber, both said first and second inlet valves being covered by said elastomeric membrane;

(e) a first outlet valve and a second outlet valve, said first outlet valve being disposed in the fluid path between the first pumping chamber and the outlet port, and said second outlet valve being disposed in the fluid path in parallel with the first outlet valve, between the second pumping chamber and the outlet port, both said first and second outlet valves being covered by said elastomeric membrane;

(f) said elastomeric membrane being partially displaced into the first and second pumping chambers when the cassette is inserted into the pump to ensure that portions of the elastomeric membrane, which in part define each of the first and second pumping chambers, are always under tension during the entire pumping cycle; and (g) said housing having openings formed therein at a plurality of locations, including over the first and the second pumping chambers, over the first and the second inlet valves, and over the first and the second outlet valves, said elastomeric membrane being exposed through said plurality of openings, for actuation by the pump during a pumping cycle, wherein:

(i) while the first inlet valve is closed and the first outlet valve is open, medicinal fluid in the first pumping chamber is forced therefrom by displacement of the elastomeric membrane into the first pumping chamber by the pump;

(ii) as the medicinal fluid is forced from the first pumping chamber, and while the second inlet valve is open and the second outlet valve is closed, the second pumping chamber fills with the medicinal fluid flowing along the fluid path from the inlet port;

(iii) thereafter, while the second inlet valve is closed and the second outlet valve is open, the medicinal fluid in the second pumping chamber is forced therefrom by displacement of the elastomeric membrane into the second pumping chamber by the pump; and (iv) as the medicinal fluid is forced from the second pumping chamber, and while the first inlet valve is open and the first outlet valve is closed, the first pumping chamber fills with the medicinal fluid flowing along the fluid path from the inlet port, said pumping cycle repeating to produce the continuous flow of medicinal fluid from the outlet port.

22. A cassette pump for delivering a continuous flow of a medicinal fluid to a patient, comprising:

(a) a cassette that includes:

(i) a sealed housing having an inlet port through which the medicinal fluid is supplied to the cassette, and an outlet port through which the medicinal fluid is delivered to the patient after being conveyed through the housing along a fluid path from the inlet port;

(ii) a first pumping chamber disposed in the fluid path between a first inlet valve and a first outlet valve;

(iii) a second pumping chamber disposed in the fluid path between a second inlet valve and a second outlet valve, in parallel with the first pumping chamber; and (iv) an elastomeric membrane sealed inside said housing, covering the first and second pumping chambers, the first and second inlet valves, and the first and second outlet valves, said housing including a plurality of openings through which the elastomeric membrane is exposed at the first and second pumping chambers, the first and second inlet valves, and the first and second outlet valves;

(b) a pump housing for receiving the cassette;

(c) a prime mover, disposed within the pump housing, drivingly coupled to a first pump plunger and a second pump plunger for successively displacing the elastomeric membrane respectively into the first pumping chamber and second pumping chamber, displacement of the elastomeric membrane into said pumping chambers forcing the medicinal fluid therefrom, the prime mover being coupled to the first and second pump plungers by a linkage that includes a rocker arm having opposite ends coupled to the first and second plunger and being driven to rock back and forth so as to reciprocatively move the first and second pump plungers by a yoke that extends between the rocker arm and a drive wheel, said drive wheel being rotated about a center of rotation by the prime mover, and said yoke being pivotally coupled to a point on the drive wheel that is offset from the center of rotation of the drive wheel; and (d) a plurality of valve actuators drivingly coupled to the prime mover to apply force to said elastomeric membrane through the openings in the housing of the cassette at the first and second inlet valves and at the first and second outlet valves, to open and close the first and second inlet valves and the first and second outlet valves during a pumping cycle in synchronization with the displacement of the first and second pump plungers respectively into the first and second pumping chambers, repetitive displacement of the medicinal fluid from one of the first and second pumping chambers by the elastomeric membrane followed by displacement of the medicinal fluid from the other of the first and second pumping chambers by the elastomeric membrane producing the continuous flow of the medicinal fluid from the outlet port.

* * * * *